US006553969B1

(12) United States Patent
Hans et al.

(10) Patent No.: US 6,553,969 B1
(45) Date of Patent: Apr. 29, 2003

(54) DEVICE FOR ASSEMBLING AND DISMANTLING A FUEL INJECTION VALVE

(75) Inventors: Waldemar Hans, Bamberg (DE); Christof Vogel, Bischberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/622,237

(22) PCT Filed: Sep. 30, 1999

(86) PCT No.: PCT/DE99/03144

§ 371 (c)(1),
(2), (4) Date: Nov. 9, 2000

(87) PCT Pub. No.: WO00/36296

PCT Pub. Date: Jun. 22, 2000

(30) Foreign Application Priority Data

Dec. 14, 1998 (DE) ..... 198 57 474

(51) Int. Cl.[7] ..... F02M 37/04
(52) U.S. Cl. ..... 123/470; 137/316; 137/315.41
(58) Field of Search ..... 123/470, 472, 123/469, 456, 468, 509; 239/600; 137/315.41, 315.11, 316

(56) References Cited

U.S. PATENT DOCUMENTS 3,589,388 A * 6/1971 Haneline, Jr. ..... 137/315
3,924,583 A * 12/1975 Jardin ..... 123/470
4,151,855 A * 5/1979 Levin et al. ..... 137/15
4,561,159 A * 12/1985 Schuster ..... 29/255
4,638,541 A * 1/1987 Schindler, Jr. ..... 29/402.06
4,901,700 A * 2/1990 Knight et al. ..... 123/470
5,070,845 A * 12/1991 Avdenko et al. ..... 123/470
5,121,731 A * 6/1992 Jones ..... 123/470
5,392,749 A * 2/1995 Stockner et al. ..... 123/470
5,893,351 A * 4/1999 Akutagawa et al. ..... 123/470
5,960,774 A * 10/1999 Norgauer et al. ..... 123/470
5,967,121 A * 10/1999 Pirch et al. ..... 123/470
6,009,856 A * 1/2000 Smith, III et al. ..... 123/470

FOREIGN PATENT DOCUMENTS

DE 197 05 990 8/1998

* cited by examiner

*Primary Examiner*—Carl S. Miller
(74) *Attorney, Agent, or Firm*—Kenyon & Kenyon

(57) ABSTRACT

An assembling device for assembling and disassembling of a fuel injector (3) in a mounting hole (3) of a cylinder head in an internal combustion engine has at least two contact surfaces engaging in the fuel injector. A hold-down surface is formed on each elastic contact element to transmit a hold-down force to the fuel injector and a locking recess in which a locking projection of the fuel injector engages to transmit a disassembling force to the fuel injector.

9 Claims, 3 Drawing Sheets

DEVICE FOR ASSEMBLING AND DISMANTLING A FUEL INJECTION VALVE

FIELD OF THE INVENTION

The present invention relates to a mounting (also referred to as assembling) device for mounting and removing (also referred to as disassembling) a fuel injector, in particular a high-pressure direct injector, into and from a mounting bore in a cylinder head of an internal combustion engine. Fuel is injected directly into the combustion chamber of the internal combustion engine through this high-pressure direct injector.

BACKGROUND INFORMATION

An assembling device having a main body at least partially surrounding the fuel injector is described in German Patent Application No. 197 05 990 A1, collar section directed inward is formed at a first end of the main body, and a collar section directed outward is formed at a second end of the main body, opposite the first end. While the collar section directed radially inward can be inserted into a groove of the fuel injector, the collar section directed outward protrudes outward from the mounting opening of the fuel injector. An appropriate tool, for example, an assembly iron, can engage the mounting hole of the cylinder head in order to lift the assembling device together with the fuel injector from the mounting hole.

This conventional assembling device is not suitable for transmitting a hold-down force to the fuel injector to counteract the combustion pressure in the combustion chamber of the internal combustion engine. Therefore, the fuel injector is held down via a separate hold-down device or the fuel injector is only secured in the mounting hole by friction. The collar section protruding inward can, however, transmit a pressure force to the fuel injector to press the fuel injector into the mounting hole. For this purpose, the collar section protruding inward engages in a corresponding groove in the fuel injector. The disadvantage, however, is that this pressure force does not act at the center and symmetrically with the central axis of the fuel injector, but in a rather one-sided manner. Furthermore, ease of handling of the assembling device when inserting the fuel injector is subject to improvement.

U.S. Pat. No. 4,561,159 describes a disassembling device for a diesel injection nozzle. An end area of the fuel injector opposite the spray orifice can be inserted at the side into a slit in the disassembling device. The disassembling device is not inserted into the mounting bore of the cylinder head and it does not remain in the mounting bore when assembled. The disassembling device described in U.S. Pat. No. 4,561,159 is instead a tool extension that is attached to the fuel injector before disassembling the fuel injector. No hold-down force is transmitted to the fuel injector. Connecting the disassembling device to the fuel injector is a relatively complicated process.

The assembling device according to the present invention having the characterizing features of claim 1 advantage over the conventional devices that the two contact elements apply a centered and symmetrical hold-down force to the fuel injector, so that an oblique position or tipping of the fuel injector is avoided. The locking connection between the assembling device and the fuel injector considerably improves handling when inserting the fuel injector into the assembling device. The fuel injector is inserted into the assembling device axially, rather than laterally, which can be better controlled, especially in partially or fully automated production.

If at least two diametrically opposite contact sections are provided, the hold-down force, as well as the disassembling force, are introduced, to a considerable degree, centrally and symmetrically to the central axis of the fuel injector.

The locking projections formed on the fuel injector have, for example, a taper facing away from the hold-down surfaces. The taper helps the locking projections engage the locking recesses provided on the contact elements.

The assembling device is guided, for example, into the mounting hole with a slight clearance in order to ensure accurate axial alignment of the assembling device with respect to the mounting hole even if the internal combustion engine installed in a vehicle, for example, is subjected to a jarring motion.

A recess for the connecting plug of the fuel injector is advantageously provided between the contact elements, so that the connecting plug of a fuel injector mounted on the assembling device is arranged between the contact elements.

The assembling device can be economically manufactured by deep drawing from a metal sheet.

DETAILED DESCRIPTION

Figure 1:
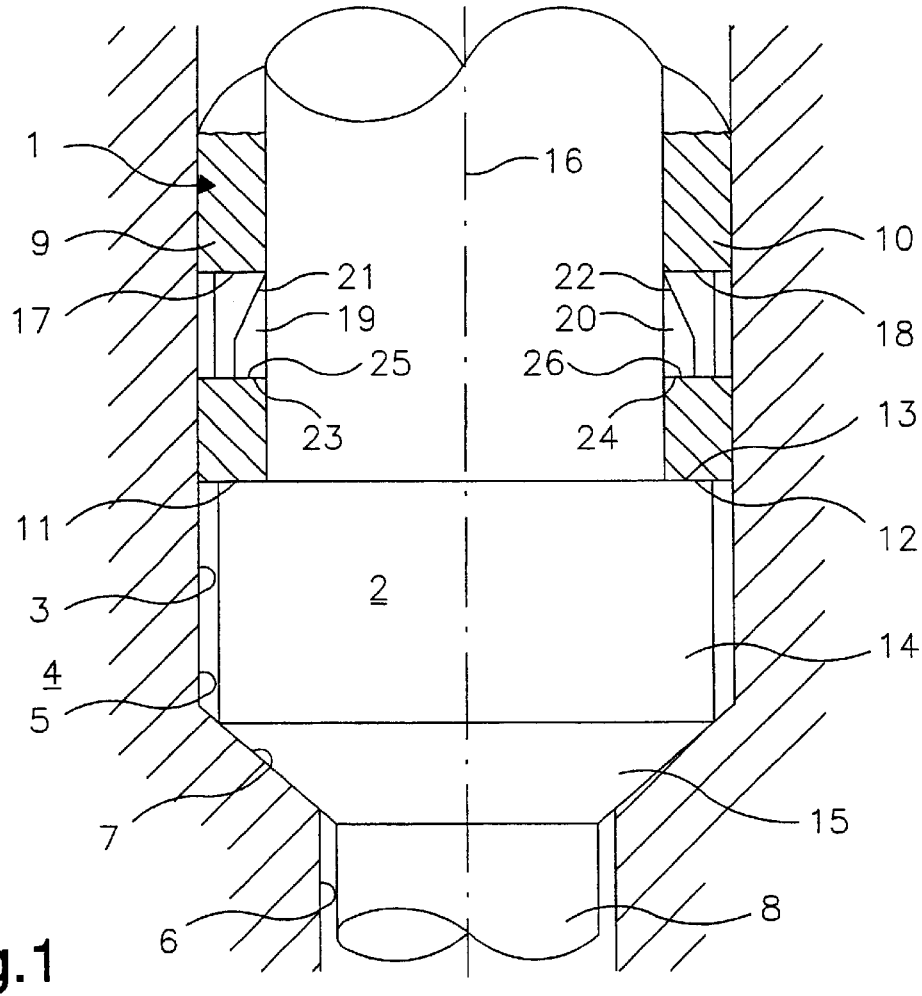
FIG. 1 shows an injection side of an embodiment of an assembling device according to the present invention, a fuel injector inserted into the assembling device according to the present invention, and a partial section of a cylinder head.

FIG. 1 illustrates the injection side of an embodiment of assembling device 1 according to the present invention. Fuel injector 2 is inserted into assembling device 1 according to the present invention. Assembling device 1 and fuel injector 2 are inserted into a mounting hole 3 of a cylinder head 4 of an internal combustion engine. Fuel injector 2 is a high-pressure direct injection valve for directly injecting fuel into the combustion chamber of the internal combustion engine.

Mounting hole 3 of cylinder head 4 is divided into a widened section 5, a narrowed section 6, and a conical section 7 that connects widened section 5 to narrowed section 6. An injection section 8 of fuel injector 2 is located in narrowed section 6 of the mounting hole 5.

Fuel injector 2 must be held down in mounting hole 3 of cylinder head 4 against the combustion pressure in the combustion chamber. Holding down fuel injector 2 in mounting hole 3 of cylinder head 4 is one of the two functions of assembling device 1 according to the present invention. As FIG. 1 shows, assembling device 1 according to the present invention has, at its injection side end, two contact elements 9 and 10, which are arranged diametrically opposite one another. Assembling device 1 may also have more than two contact elements, for example, three or four contact elements, which are, arranged, for example, peripherally evenly distributed. Each of the two contact elements 9 and 10 has a front hold-down surface 11 and 12, which engages in an annular countersurface of a housing body 14 of fuel injector 2 in order to hold down fuel injector 2 against the combustion pressure in the combustion chamber. Fuel injector 2 is held at a conical section 15 against conical section 6 of mounting hole 3 by the hold-down force of assembling device 1. Due to the conical design of a section of mounting hole 3 and fuel injector 2, accurate alignment of fuel injector 2 with respect to central axis 16 of mounting hole 3 is guaranteed.

The two contact elements 9 and 10 are connected to a main body (not shown in FIG. 1), which surrounds fuel injector 2 preferably in an annular shape. A fastening section (also not illustrated) of the main body protrudes from mounting hole 3 of cylinder head 4 and can be fastened to cylinder head 4. The area of the fastening section can be adjusted to the specific geometric configuration of cylinder head 4. The hold-down force can be exerted onto assembling device 1 by the mounting screws provided on the fastening section, for example.

Fastening device 1, for example, has very small play with respect to mounting hole 3 of cylinder head 4, so that assembling device 1 is accurately guided in mounting hole 3, and fuel injector 2 is accurately aligned axially even under rough conditions, for example, in the event of a jarring motion.

The two contact elements 9 and 10 also have two locking recesses 17 and 18, which in the present embodiment are closed on all sides. Locking recesses 17 and 18 have a rectangular cross section in the present embodiment. Locking projections 19, 20, radially formed on fuel injector 2, can be inserted into locking recesses 17 and 18, respectively, by pushing fuel injector 2 into assembling device 1 in the axial direction.

Locking projections 19 and 20 for example, have tapers 21 and 22 facing away from hold-down surfaces 11 and 12, which elastically support contact elements 9 and 10 radially outward when fuel injector 2 is inserted. As soon as locking projections 19 and 20 fully engage with locking recesses 17 and 18, contact elements 9 and 10 retract elastically, so that fuel injector 2 is secured on contact elements 9 and 10 via locking projections 19 and 20. Fuel injector 2 is fastened to assembling device 1 prior to inserting fuel injector 2 and assembling device 1 into mounting hole 3 of cylinder head 4. After assembling device 1 has been inserted into mounting hole 3, assembling device 1, due to its small play with respect to mounting hole 3, is secured against radial separation of contact elements 9 and 10 and loosening of locking projections 19 and 20.

FIGS. 4A–4D illustrate the extension of the assembling device 1 and fuel injector 2 during disassembly. Locking projections 19 and 20 have contact surfaces 23 and 24, respectively, on which a countersurface 25, 26 formed on contact element 9, 10 engages during disassembly. Therefore, when assembling device 1 is pulled out of mounting hole 3, fuel injector 2 is also pulled out axially, being pulled out of mounting hole 3 as shown sequentially in FIGS. 4A–4D.

Mounting fuel injector 1 on assembling device 1 is considerably facilitated by the snap-in connection formed by locking recesses 17 and 18, and locking projections 19 and 20, which substantially improves handling. Fuel injector 2 is brought to assembling device 1 not laterally, but in the axial direction, which may be of a considerable advantage in automatic manufacturing.

Figure 2:
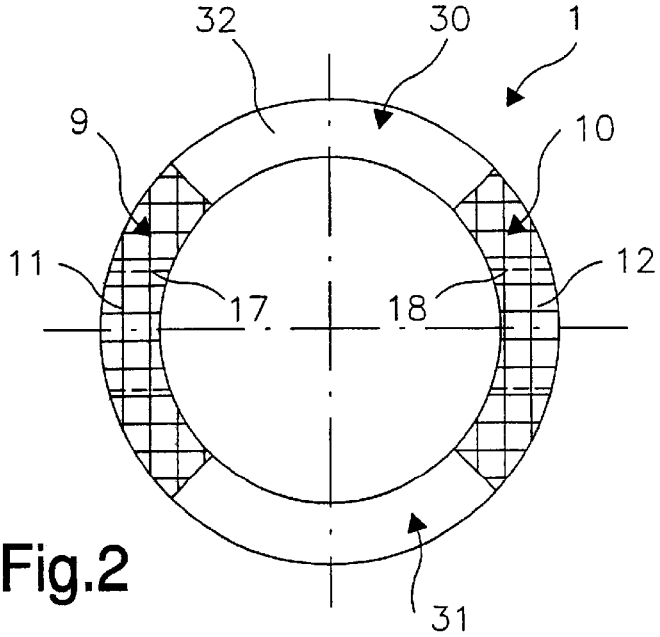
FIG. 2 shows a top view of the injection-side end of the embodiment of an assembling device according to the present invention illustrated in FIG. 1.

FIG. 2 shows the embodiment of assembling device 1 illustrated in FIG. 1 as a top view onto the injection-side end, i.e., from below in FIG. 1. The two contact elements 9 and 10 can be seen, hold-down surfaces 11 and 12 being provided with cross-hatching for greater clarity in FIG. 2. Furthermore, locking recesses 17 and 18 can be seen in both contact elements 9 and 10. A recess 30 and 31 is located between the two diametrically opposite contact elements 9 and 10, with at least one of the two recesses 30 and 31 having a width such that a connecting plug of fuel injector 2 can be received by this recess 30 and 31. The connecting plug is arranged, after fuel injector 2 is secured on fastening device 1, between the two contact elements 9 and 10.

The two contact elements 9 and 10 are elastically connected to a main body 32 extending between the two contact elements 9 and 10 against the direction of injection or are designed in one piece with main body 32. Main body 32, for example, surrounds fuel injector 2 on all sides as a ring.

Figure 3:
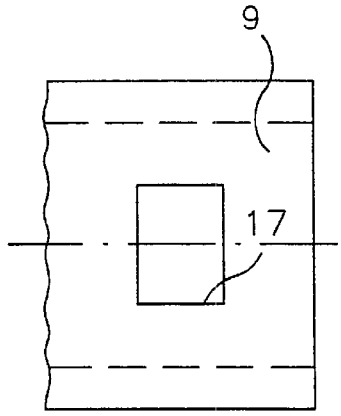
FIG. 3 shows a side view of the injection-side end of the embodiment of the assembling device according to the present invention illustrated in FIG. 1.
Figure 4B:
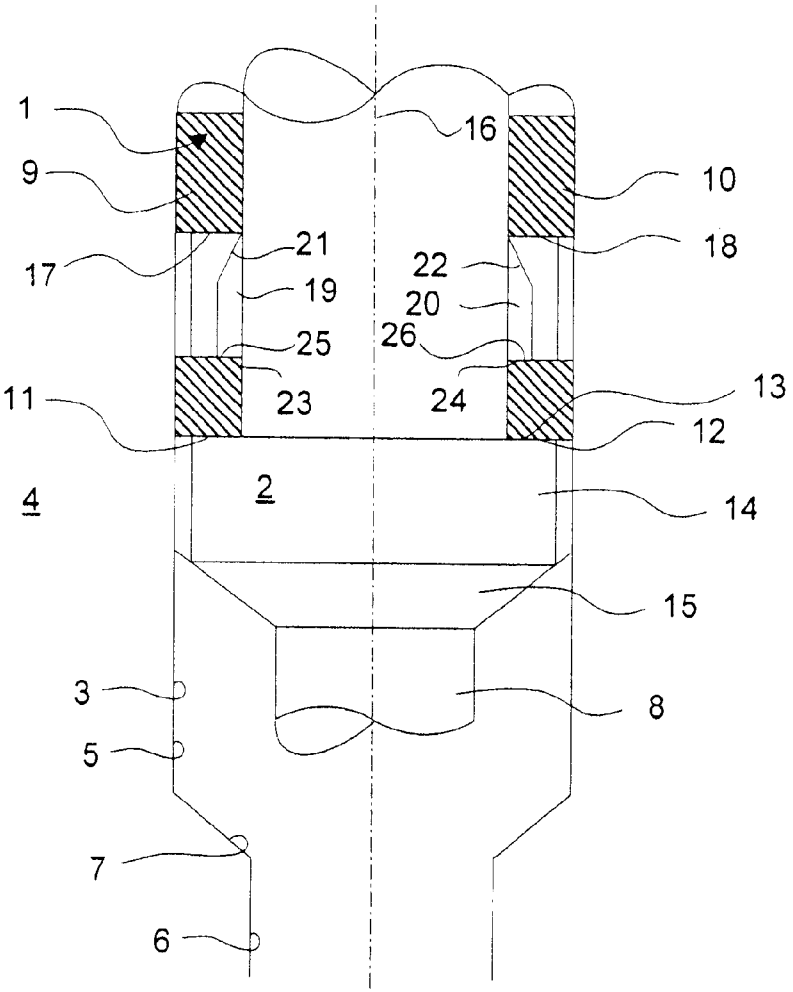
FIGS. 4A–4D show an exemplary sequential extension of the assembling device and the fuel injector according to the present invention, being removed from a mounting hole.
Figure 4A:
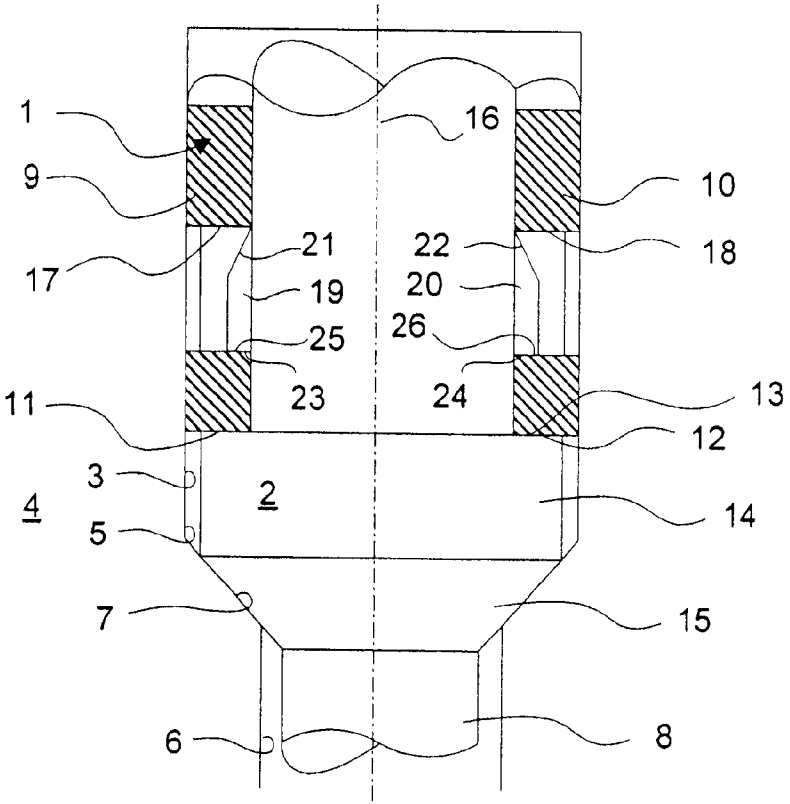
Figure 4D:
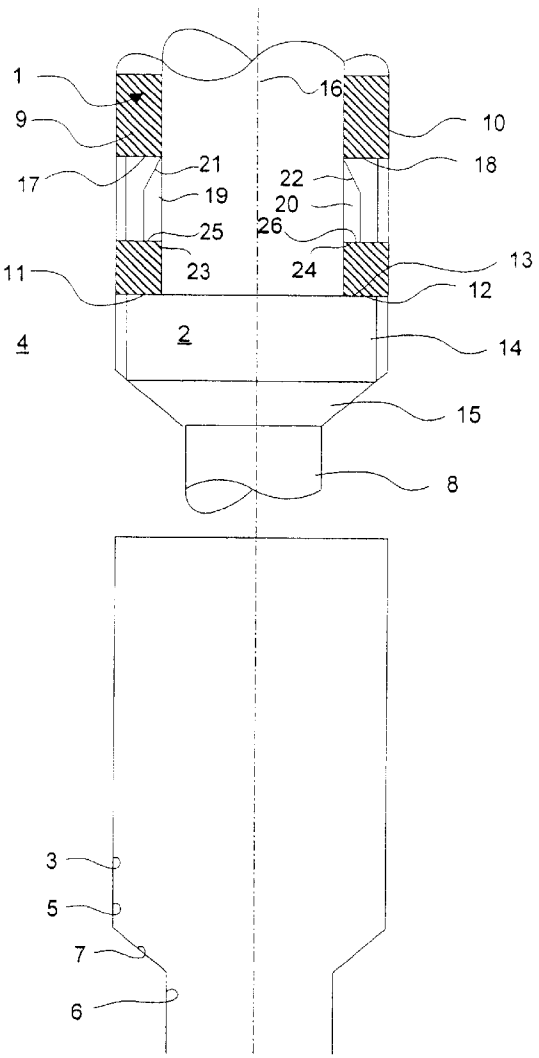
Figure 4C:
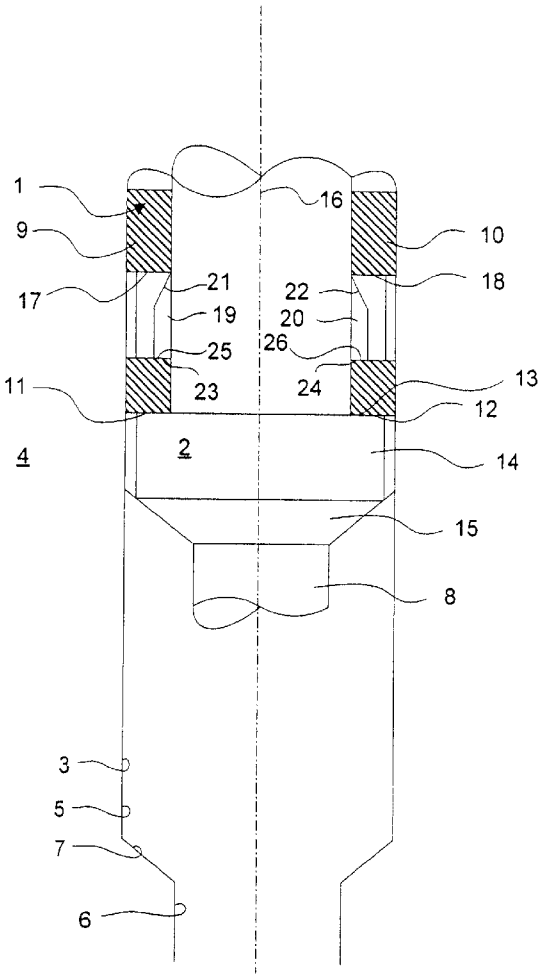

FIG. 3 shows a side view of the embodiment of assembling device 1 illustrated in FIGS. 1 and 2 to better elucidate the present invention. One of the two contact elements 9 and locking recess 17, which is rectangular in this embodiment are shown here.

What is claimed is:

1. A mounting device for mounting and removing a fuel injector in a mounting hole of a cylinder head of an internal combustion engine, the assembling device comprising:

at least one contact element configured to act upon the fuel injector and to apply a hold-down force to hold down the fuel injector in the mounting hole and a removing force to remove the fuel injector, the at least one contact element including at least two elastic contact elements having a hold-down surface and a locking recess, the hold-down surface being configured to transmit the hold-down force to the fuel injector, the locking recess being configured to engage a locking projection of the fuel injector to transmit the removing force to the fuel injector.

2. The device according to claim 1, wherein:

two diametrically opposite contact elements are provided.

3. A device according to claim 1, wherein:

the at least one contact element is axially adjacent to a main body of the mounting device and radially elastically connected to the main body.

4. The device according to claim 3, wherein:

the main body has a fastening section configured to protrude from the mounting hole and to fasten the cylinder head.

5. The device according to claim 1, wherein:

the locking projection formed on the fuel injection has a taper facing away from the hold-down surface.

6. The device according to claim 1, wherein:

the locking recess is enclosed on all sides and has an substantially rectangular cross section.

7. The device according to claim 1, wherein:

the device is configured to be guided into the mounting hole with small play.

8. The device according to claim 1, wherein:

a recess for a connecting plug of the fuel injector is provided between the at least two elastic contact elements.

9. The device according to claim 1, wherein:

the device is manufactured from sheet metal by deep drawing.

* * * * *

UNITED STATES PATENT AND TRADEMARK OFFICE

CERTIFICATE OF CORRECTION

PATENT NO. : 6,553,969 B1
DATED : April 29, 2003
INVENTOR(S) : Hans Waldemar et al.

It is certified that error appears in the above-identified patent and that said Letters Patent is hereby corrected as shown below:

Title page,
Item [57], ABSTRACT,
Line 2, delete "(3), (3)"

Column 1,
Line 17, change "990 A1, collar" to -- 990. A collar --
Line 55, insert -- SUMMARY OF THE INVENTION --

Signed and Sealed this

Third Day of August, 2004

JON W. DUDAS
*Acting Director of the United States Patent and Trademark Office*